US005150834A

United States Patent [19]

Bourke

[11] Patent Number: 5,150,834

[45] Date of Patent: Sep. 29, 1992

[54] NEWSPAPER DELIVERY BOX

[76] Inventor: Michael J. Bourke, 16 First Avenue, Ottawa, Ontario, Canada, K1S 2G2

[21] Appl. No.: 652,598

[22] Filed: Feb. 8, 1991

[51] Int. Cl.[5] ..... B65D 91/00

[52] U.S. Cl. ..... 232/1 C; 232/22; 70/63

[58] Field of Search ..... 232/17, 19, 22, 23, 232/1 C, 15, 2; 70/63, 30, 49

[56] References Cited

U.S. PATENT DOCUMENTS

| | | | |
|---|---|---|---|
| 1,190,193 | 7/1916 | Rese | 232/22 |
| 1,275,579 | 8/1918 | McGowan | 232/2 |
| 2,437,584 | 3/1948 | Zamora | 232/2 |
| 2,845,217 | 7/1958 | Jacques | 232/17 |
| 3,798,934 | 3/1974 | Wright | 70/49 |
| 4,474,116 | 10/1984 | Castenada | 70/63 |
| 4,573,332 | 3/1986 | Ma | 70/30 |
| 4,667,491 | 5/1987 | Lokken et al. | 70/63 |
| 4,799,370 | 1/1989 | Cooper | 70/63 |
| 4,867,478 | 9/1989 | Anderson | 70/30 X |
| 4,901,912 | 2/1990 | Pinard | 232/1 C |
| 4,981,259 | 1/1991 | Ahmann | 232/2 |
| 4,987,836 | 1/1991 | Owen | 70/63 |
| 4,998,424 | 3/1991 | Lambert | 70/63 |

FOREIGN PATENT DOCUMENTS

| | | | |
|---|---|---|---|
| 884747 | 11/1971 | Canada | 232/16 |
| 1203787 | 4/1986 | Canada | 232/9 |
| 165543 | 11/1905 | Fed. Rep. of Germany | 232/22 |
| 204364 | 11/1908 | Fed. Rep. of Germany | 232/22 |
| 255989 | 5/1912 | Fed. Rep. of Germany | 232/22 |
| 1032266 | 3/1953 | France | 70/69 |
| 1222798 | 1/1960 | France | 232/19 |
| 2261206 | 9/1975 | France | 232/17 |
| 805842 | 12/1958 | United Kingdom | 232/2 |

*Primary Examiner*—Renee S. Luebke
*Assistant Examiner*—Michael J. Milano

[57] ABSTRACT

A newspaper delivery box is provided for attachment to or placement outside the door of a house or apartment. The box is provided with a hinged top having a one-way slot, a lock adapted to lock the lid to the main portion of the box and a tether adapted to secure the box to a door knob or the like behind the closed door.

13 Claims, 3 Drawing Sheets

NEWSPAPER DELIVERY BOX

BACKGROUND OF THE INVENTION

This invention relates to newspaper delivery boxes of the type used on the outside of house or apartment doors. Boxes of this type are used to prevent the theft of newspapers or other delivered material and are generally mounted either on the front door or on an outside wall adjacent the front door. Boxes of this type are known in the prior art, for example in Canadian patents 884,747 (Fibus et al) and 1,203,787 (Dupuis).

It is desirable to provide several features in such boxes. First, they should be easily lockable and unlockable, and second they should be capable of being simply and readily attached to the front door or outside wall. It is desirable to provide a box with a keyless locking system, and that is mountable without the use of screws or the like, for example by suspending the box from the front door knob. It is also desirable to provide a box that uses a minimum of material in its construction and is thus lightweight and inexpensive.

Accordingly, the present invention is a newspaper delivery box comprising:

(a) a lower body portion having a bottom and sides;

(b) an upper body portion hinged to the lower portion having a one-way slot therein communicating with the interior of the lower portion, said slot being adapted to allow a newspaper or the like to be inserted into the lower portion but to substantially prevent removal thereof;

(c) a lock adapted to lock together the upper and lower parts;

(d) a tether fixed to the container and adapted to pass around and be firmly secured behind a closed door.

In a preferred embodiment, the upper body portion is comprised of relatively thin top and side walls and a rigid bottom spaced apart from the top wall, and the slot is provided with side walls that taper inwardly and downwardly between the top and bottom walls, the lower end of the slot being sufficiently narrow to prevent removal of objects from within the box. The sidewalls and bottom of the lower body portion are relatively thin and are attached to a rigid top having an opening therein through which a newspaper may be inserted or removed. The lock in the preferred embodiment comprises a resilent hook extending downwardly from the rigid bottom of the upper body portion, the resilent hook biased towards a corresponding aperture within the rigid top of the lower body portion. The aperture communicates with a channel that extends the length of the top. The tether is slidably engaged within the channel. The tether is provided with a projection which when it is slid past the hook pushes it outside the aperture to unlock the top body portion. In the locked position, the tether extends inside the door to be looped over the inside knob, with the projection being behind the closed door.

BRIEF DESCRIPTION OF THE DRAWINGS

The invention will now be described by way of a description of a preferred embodiment, wherein.

DETAILED DESCRIPTION OF THE PREFERRED EMBODIMENT

Figure 1:
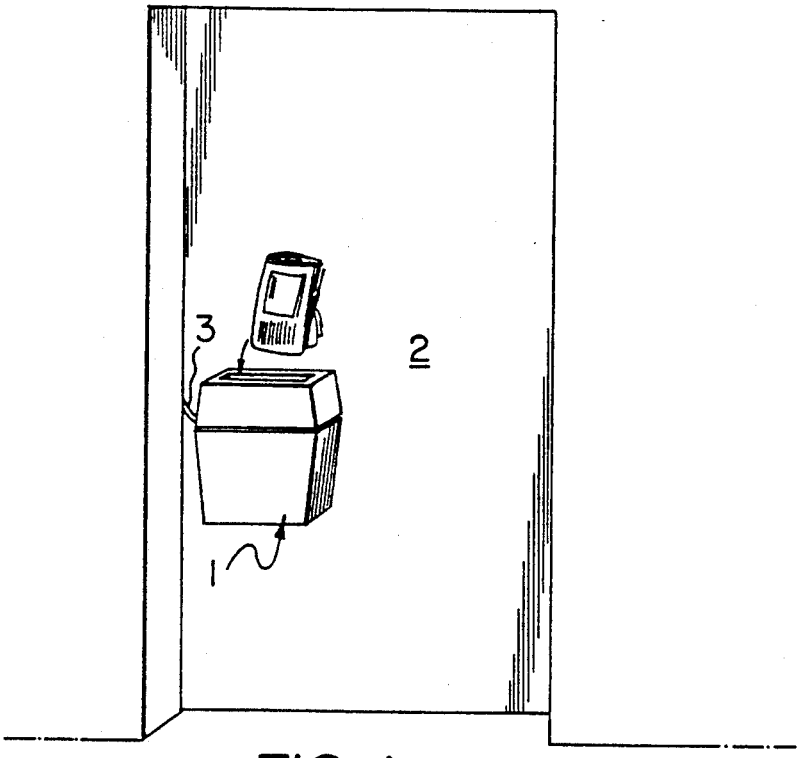
FIG. 1 is an illustration of the invention mounted to an apartment door.

Referring to FIG. 1, a newspaper delivery box 1 of the present invention is mounted to an apartment door 2. A tether 3 comprising a flexible strap provided with a loop at one end thereof (not shown), extends from the box 1 around the backside of the door 2 and the loop is attached to an inside door knob (not shown) thereof to anchor the box. The tether 3 serves both to lock the box shut, as will be described below, and to prevent it from being removed from the door.

Figure 2:
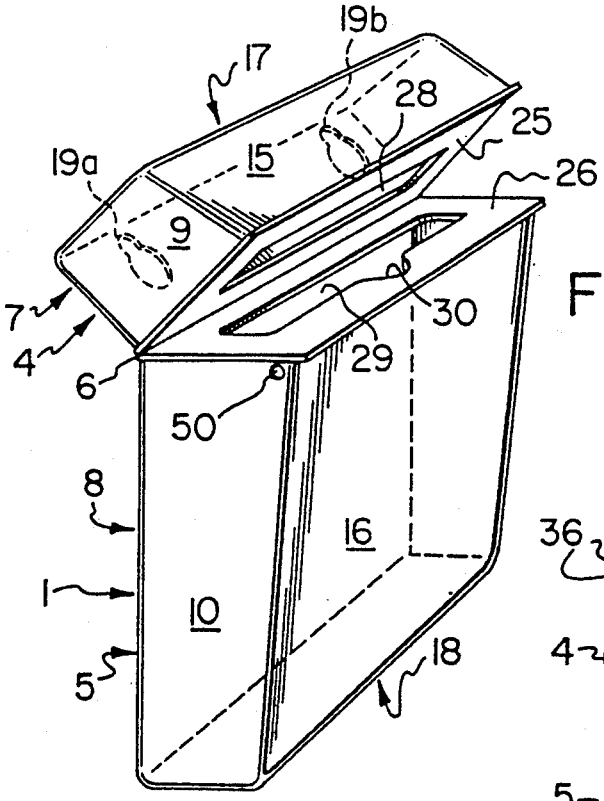
FIG. 2 is a schematic view, in perspective, of the device in the open position.
Figure 4:
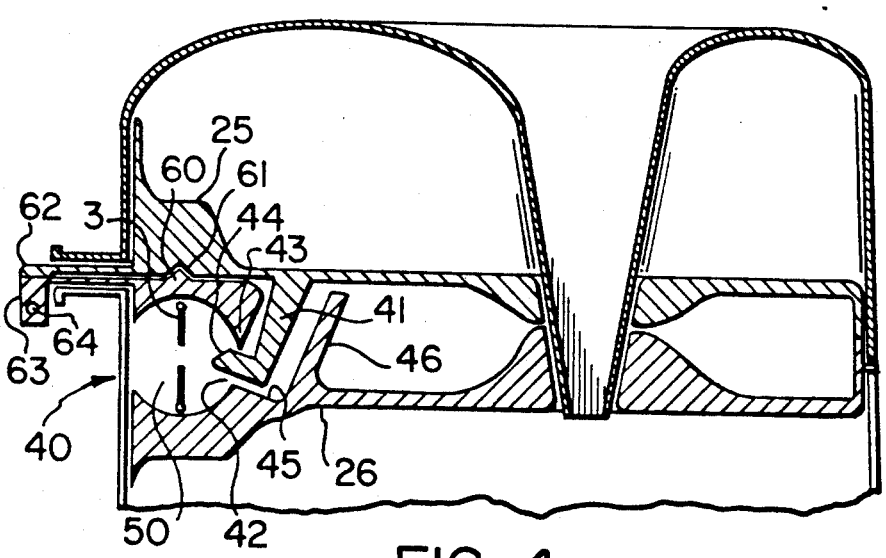
FIG. 4 is a cross sectional view of the upper part of an alternative from of the device in the closed position, not to scale, with the rigid frame panels enlarged for detail.

Referring to FIG. 2, the box 1 is provided with upper and lower body portions 4 and 5, connected by a hinge 6 at the rear side of the box. Preferably, the upper and lower body portions are made of a thin resilient plastic, and the rear walls 7 and 8 of upper and lower body portions 4 and 5 comprise a single sheet, the hinge 6 being simply an exposed portion thereof. The upper and lower portions are provided as well with sides 9 and 10 respectively, front walls 15 and 16, and a top 17 and bottom 18 of the top portion and bottom portion respectively. The rear wall 8 of the lower part is provided with two keyhole shaped slots 19(*a*) and 19(*b*) of suitable size and shape to allow the box to be hung from a door knob. The slots 19(*a*) and (*b*) are each positioned adjacent an edge of the rear wall 8, to allow the box to be hung from a door knob positioned on the left or right hand side of the door. The box may as well be placed on the floor outside the door or hung from a separate knob fixed to the outside wall of the house or apartment. Rigid upper and lower frame members 25 and 26 comprise the bottom surface of the upper part and the upper surface of the bottom part, respectively. In the closed position, these frame members are spaced apart from each other, as shown in FIG. 4, to hinder a person from reaching through the slot to retrieve a newspaper from within the box. The frame members 25 and 26 are provided with communicating slots 28 and 29, respectively. The lower slot 29 has a widened part 30 to allow for hand retrieval of the paper when the box is opened. The rigid upper and lower frame members provide a rigid, non-deformable support for the upper and lower body portions respectively, and allow the body portions to be constructed of a lightweight flexible plastic and still retain their shape and remain secure against forceable entry.

Figure 3:
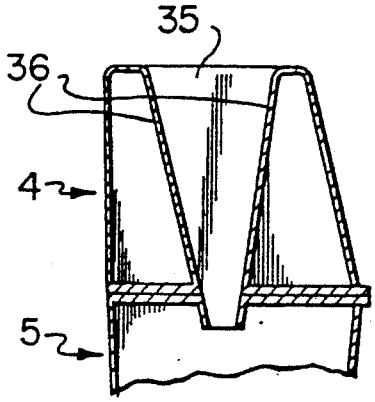
FIG. 3 is a schematic cross sectional view of the upper part of the device in the closed position.

Referring to FIG. 3, the upper portion 4 is provided with a tapered elongate chute 35 that extends through the slots 28 and 29 and communicates with the interior of the lower portion 5. The chute 35 extends the full length of the slots 25 and 26. The chute 35 is comprised of side walls 36 that taper inwardly towards the bottom of the chute. The chute 35 is fabricated of a resilient material and its exposed lower edges are rounded, so as to provide a measure of safety in the event a child puts his or her fingers into the chute. The resiliency of the material and the rounded edges minimize the risk of injury to the childs fingers.

Figure 5:
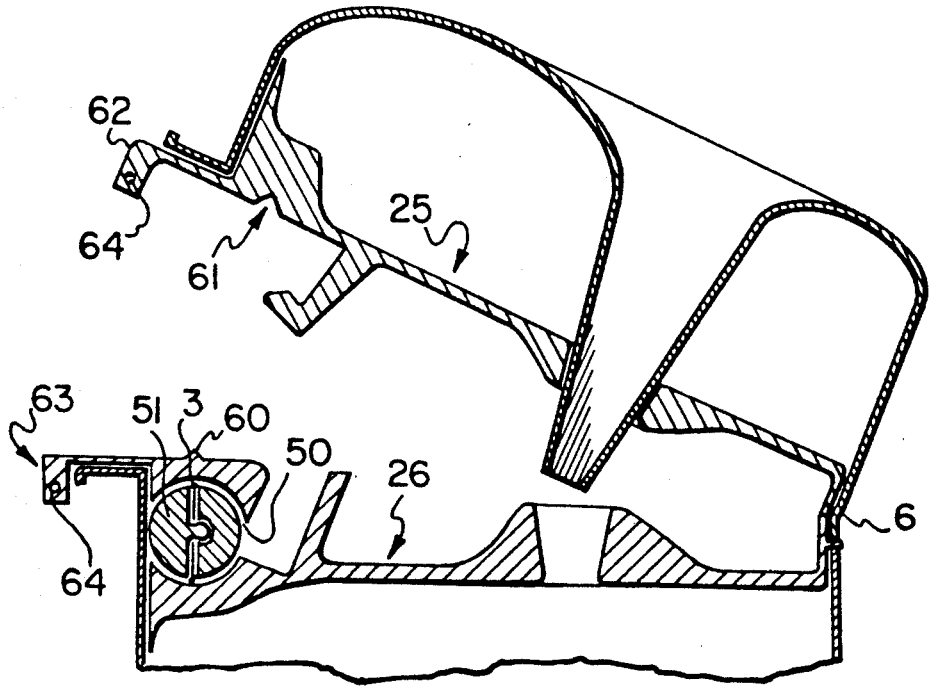
FIG. 5 is a cross sectional view as in FIG. 4, showing the device in the open position.

Referring to FIGS. 4 and 5, the upper and lower frame members are provided with a lock 40, comprised of a latch 41 depending downwardly from the upper frame member 25, engagable with a slot 42 in the lower frame member 26. The latch 41 has an upwardly-angled hook 43 that engages a catch comprising the upper face 44 of the slot 42. The slot 42 has a lower face 45 that angles downwardly and rearwardly, and serves to maintain the hook 43 in the locked position. The latch 41 is formed of a resilient material and may be flexed rearwardly by the lock-releasing means described below, out of the channel 42 to release the hook 43. A guard 46 extends upwardly from the lower frame member 26, to prevent unwanted intruders from reaching into the chute and pulling the hook 43 out of the slot 42.

The slot 42 communicates with a channel 50 extending the length of the lower frame member 26, the ends of the channel 50 being open at the sides of the frame member 26. The tether 3 is slidably engaged within the channel 50.

The upper and lower frame members 25 and 26 are provided with a centering mechanism comprising a tongue 60 extending upwardly from the lower frame member, mating with a groove 61 within the upper frame member.

A supplemental lock mechanism is provided, comprising extensions 62 and 63 extending from the upper and lower frame members respectively. Each extension is provided with an aperture 64. When the box is in the closed position, the apertures 64 are aligned. A padlock, not illustrated, may be inserted through the apertures.

Figure 6:
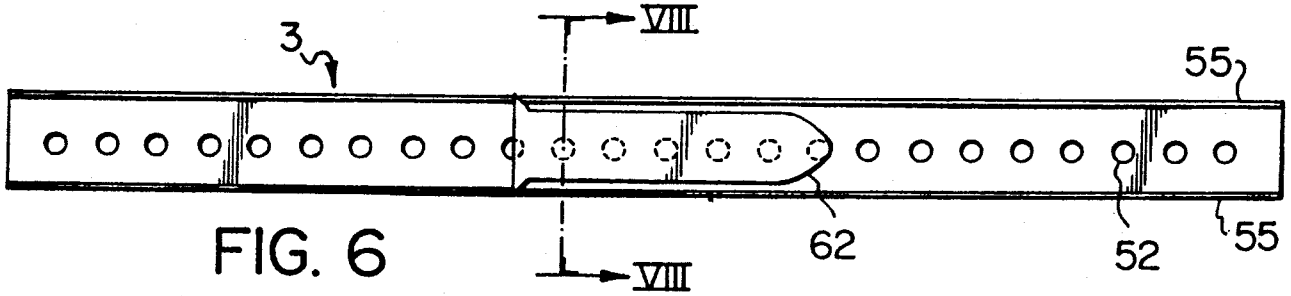
FIG. 6 is a side view of a portion of the tether, illustrating the lock releasing projection attached thereto.
Figure 7:
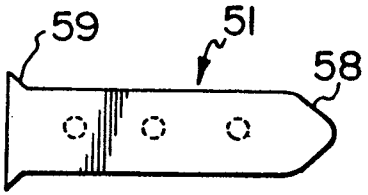
FIG. 7 is a side view of the lock releasing projection detached from the tether.
Figure 8:
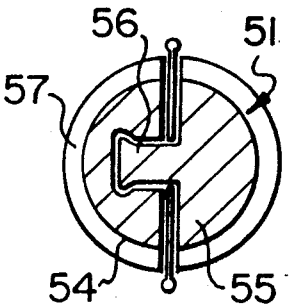
FIG. 8 is a sectional view along lines VIII—VIII of FIG. 6.

As illustrated in FIG. 6, the tether 3 is comprised of a flat flexible plastic web having holes 52 therethrough to engage various attachments, and reinforcing wires 55 at the edges thereof. A lock-releasing projection 51, illustrated at FIGS. 7 and 8 is connected to the tether 3. The projection 51 comprises first and second halves 54 and 55 that sandwich the tether 3. The two halves 54 and 55 are snap fitted to each other by multiple pins 56 extending from the second halve 55 through the holes 52 into a corresponding recess 57 within the first half 54. The projection 51 has a rounded nose 58 and a flared tail 59. As illustrated in FIG. 5, when the tether 3 is drawn through the channel 50 pass the hook 41, the projection 51 pushes the lip 43 of latch 41 out of the slot 43, and causes the latch 41 to release.

In use, the container is either suspended from a door knob or simply left on the floor, and the top portion snapped shut. The free end of the tether is then looped around the inside door knob, and the apartment door closed on it with that portion of the tether having the lock-releasing projection 51 inside the door. Alternatively, the projection 51 may be positioned inside the channel 50, with the free end of the tether looped over the inside doorknob. If there is sufficient tension in the tether, the projection 51 cannot be moved sufficiently to disengage the lock 40 until the tether is detached from the doorknob. Once the door is closed, the projection cannot be pulled outside the door. A newspaper or other material may be inserted into the box through the chute 35. Once the newspaper is within the box it is virtually impossible for an intruder to remove it from the box, due to the narrowness of the slots 28 and 29 within the frame members 25 and 26. Further, the spacing between the frame members 25 and 26 provides rigid support to the lower narrow end of the chute 35 and prevents an intruder from manipulating his or her fingers within the slot sufficiently to grasp a newspaper within the box.

With the present design, the walls of the upper and lower parts 4 and 6 may be molded of relatively thin flexible plastic. The upper and lower frame members 25 and 26 provide a rigid frame for the walls, and the structural strength of the box; if the frame members are made of a suitably rigid material, the remainder of the box may be made of relatively inexpensive thin material.

The embodiment of the invention described herein is intended to be illustrative only of the invention, the full spirit and scope of which is set out in the appended claims.

I claim:

1. A newspaper delivery box comprising:

(a) a lower body portion having a bottom and sides:

(b) an upper body portion hinged to the lower portion having a one-way newspaper-receiving slot therein communicating with the interior of the lower portion, said slot being adapted to allow a newspaper to be inserted into the lower portion but substantially preventing removal thereof;

(c) a lock adapted to lock together the upper and lower portions said lock comprising a hook extending from said upper portion engagable with an aperture in the lower portion, said hook being biased towards the aperture; and (d) a tether attached to said delivery box and adapted to pass around and be firmly secured behind a closed door, said tether slidably extending within a channel in said box, said channel communicating with said lock aperture, and said tether including lock release means comprising a projection extending from the tether and adapted to engage the hook and urge the hook away from the aperture when the tether is passed through the channel.

2. A newspaper deliver box as in claim 1 wherein the tether is in the form of a flat strap having reinforcing wires at the edges thereof with a resilient web therebetween.

3. A newspaper delivery box as in claim 2 wherein the web includes perforations for mounting said lock release means to the tether.

4. A newspaper delivery box as in claim 1 wherein said newspaper receiving slot is provided with a chute depending downwardly therefrom and extending into the box.

5. A newspaper delivery box as in claim 4, wherein said chute has side walls that converge inwardly and downwardly towards each other.

6. A newspaper delivery box as in claim 1 wherein said lower body portion comprises a rigid upper plate having an opening therein, and said sides and bottom connected to said upper plate.

7. A newspaper delivery box as in claim 6 wherein said upper portion is comprised of a top and sides, said sides attached to a rigid lower plate, and upper and lower plates having a one-way slot extending therethrough and communicating with the interior of the lower portion.

8. A newspaper delivery box as in claim 1 which includes mounting means for removably mounting the container on a door handle.

9. A newspaper delivery box as in 8 wherein the mounting means comprises an opening in a side of the lower portion for suspending the box on a doorknob.

10. A newspaper delivery box as in claim 7 wherein the bottom and sides of the lower portion are formed of a flexible sheet material.

11. A newspaper delivery box as in 10 wherein the top and sides of the upper portion are formed of a flexible sheet material.

12. A newspaper delivery box as claimed in claim 11 wherein the upper and lower portions have front sides and rear sides, the upper and lower portion rear sides being formed of a single sheet of said flexible sheet material.

13. A newspaper delivery box as claimed in claim 12 wherein hinging between the upper and lower portions is provided by the flexibility of said single sheet.

* * * * *